US005398036A

United States Patent [19]

Nakase et al.

[11] Patent Number: 5,398,036

[45] Date of Patent: * Mar. 14, 1995

[54] SHORTENED MAST ANTENNA WITH COMPENSATING CIRCUITS

[75] Inventors: Kazuhiko Nakase, Tokyo; Tetsuyoshi Abiko, Kanagawa, both of Japan

[73] Assignee: Harada Kogyo Kabushiki Kaisha, Tokyo, Japan

[ * ] Notice: The portion of the term of this patent subsequent to Jul. 29, 2009 has been disclaimed.

[21] Appl. No.: 999,190

[22] Filed: Dec. 28, 1992

Related U.S. Application Data

[63] Continuation of Ser. No. 491,489, Mar. 9, 1990, abandoned.

[30] Foreign Application Priority Data

Mar. 10, 1989 [JP] Japan ..... 63-120169

[51] Int. Cl.[6] ..... H01Q 1/50; H01Q 1/32

[52] U.S. Cl. ..... 343/860; 343/715; 343/745; 455/293

[58] Field of Search ..... 343/702, 860, 745, 715, 343/900, 901, 903, 701; 333/213; 455/290, 291, 293, 297; H01Q 1/32, 1/50

[56] References Cited

U.S. PATENT DOCUMENTS

| | | | |
|---|---|---|---|
| 2,021,734 | 11/1935 | Macalpine | 343/860 |
| 2,810,070 | 10/1957 | Yates | 343/745 |
| 3,965,426 | 6/1976 | Ringland | 343/701 |
| 4,228,544 | 10/1980 | Guyton | 343/860 |
| 4,757,277 | 7/1988 | Nakase et al. | 455/292 |
| 4,850,034 | 7/1989 | Campbell | 455/74 |
| 5,151,708 | 9/1992 | Nakase et al. | 343/722 |

FOREIGN PATENT DOCUMENTS

| | | | |
|---|---|---|---|
| 2115657 | 10/1972 | Germany | 343/701 |
| 7901901 | 9/1979 | Netherlands | 343/701 |

*Primary Examiner*—Donald Hajec
*Assistant Examiner*—Hoanganh Le
*Attorney, Agent, or Firm*—Koda and Androlia

[57] ABSTRACT

A shortened mast antenna with a compensating circuit between the antenna and a receiver and used in a state shorter than the resonant state of the antenna. The compensating circuit includes an FM compensating circuit made up with passive elements and compensating FM broadcast signals and an AM compensating circuit equipped with active elements which convert a high impedance into a low impedance so that the AM compensating circuit compensates AM broadcast signals. The attachment part of the antenna, to which the compensating circuit is directly connected, has a stray capacitance of 10 PF or less.

4 Claims, 3 Drawing Sheets

SHORTENED MAST ANTENNA WITH COMPENSATING CIRCUITS

This is a continuation of application Ser. No. 491,489, filed Mar. 9, 1990, now abandoned.

BACKGROUND OF THE INVENTION

1. Field of the Invention

The present invention relates to antennas installed on automobiles and used for receiving AM/FM bands and more particularly to a shortened mast antenna with compensating circuits.

2. Prior Art

When shortened mast antennas are used in automobiles for receiving AM/FM bands, a conspicuous sensitivity drop is likely to occur. Conventionally, it has been the practice to connect an AM broad-band amplifier and an FM broadband amplifier in parallel and insert these amplifiers between the antenna and a feeder line.

Specifically, when an AM/FM antenna is used in the FM frequency band, if such an antenna is shorter than the resonant state e.g., at a length of 50 cm (with a 6 mm diameter) which is approximately ½ the length which resonates at FM frequencies as shown in FIG. 6(2), then the antenna resistance Ra will become approximately 10 ohms (FIG. 6(1)). This is lower than the resistance in the resonant state (which is approximately 75 ohms) and results in an antenna reactance Xc of approximately −200 ohms (equivalent electrostatic capacitance: approximately 12 PF).

Automobile antennas usually have a telescopic structure so that the antenna is retracted inside the vehicle body when not used. As a result, the stray capacitance at the base of the antenna is generally 20 PF to 40 PF due to the mechanical structure involved. Because of this stray capacitance, the apparent antenna resistance becomes even lower.

If a commonly used coaxial feeder line (which has a characteristic impedance of 50 ohms to 200 ohms) is directly connected to such an antenna, the mismatch loss becomes larger and the band width becomes extremely narrow. Thus, it is impossible to get FM reception with good sensitivity. Conventionally, this problem has been solved by inserting broadband amplifiers between the antenna and the feeder line, as mentioned above.

If the AM/FM antenna is approximately 50 cm long so that it is used in the AM frequency band, such antenna length is extremely short compared to wavelengths in the AM frequency band. Accordingly, the antenna resistance Ra becomes virtually 0 ohms, and the antenna reactance Xc becomes −20 kilo-ohms to −50 kilo-ohms (equivalent electrostatic capacitance: approximately 7 PF), resulting in an extremely high-impedance antenna.

When an antenna and a radio receiver are connected by a coaxial feeder line, the feeder-line is shorter than the wavelength involved. Thus, in this case there is no need to consider impedance matching. However, there is a capacitance splitting loss arising from the antenna capacitance and the antenna stray capacitance plus feeder line electrostatic capacitance, resulting in a considerable drop in reception sensitivity.

Furthermore, in the case of a motor-driven antenna, the length of the feeder line reaches 4 to 5 m, and the electrostatic capacitance of the feeder line reaches 150 to 300 PF or greater. As a result, the splitting loss amounts to as much as −25 to −35 dB.

In view of the above, a low-capacitance cable with a high characteristics impedance is used in some cases in order to reduce the capacitance splitting loss. In such cases, however, the FM signal matching loss increases, and the FM reception sensitivity becomes poor.

Conventionally, therefore, a compromise between the above-described two situations has been adopted, and coaxial cables with a capacitance of 30 to 50 PF/m have been commonly used.

When strong electromagnetic waves are received in conventional devices mentioned above, the electromagnetic waves are amplified in the non-linear ranges of the broad-band amplifiers, so that amplitude distortion is generated, and the sound that is received is distorted.

Furthermore, when an attempt is made to receive other waves among strong electromagnetic waves, cross modulation distortion and intermodulation distortion are generated by the non-linear distortion of the broad-band amplifiers. As a result, not only is the received sound distorted, but reception may become impossible in some cases.

In addition, because of noise generated by the broad-band amplifiers, the practical reception sensitivity drops. In other words, the receiver input signal level required in order to achieve the prescribed S/N ratio, e.g., 20 dB in the case of AM broadcast waves and 30 dB in the case of FM broadcast waves, is increased.

Furthermore, since both AM and FM broad-band amplifiers are used, the overall cost of the antenna increases. If high-performance amplifiers with a high linearity are used to prevent such distortion of the received sound, the cost is increased even further.

SUMMARY OF THE INVENTION

Accordingly, it is an object of the present invention to provide a shortened mast antenna equipped with compensating circuits which can prevent distortion of the received sound where strong electromagnetic waves are received and also prevents faulty reception where an attempt is made to receive other electromagnetic waves among strong electromagnetic waves. The antenna further prevents any practical reception sensitivity drop and can be manufactured for less costs.

Specifically, the present invention is characterized in that in an automobile radio antenna used in a manner shorter than the resonant state of the antenna, (a) the stray capacitance at the attachment part of the antenna is 10 PF or less, (b) an FM compensating circuit is provided which is formed with passive elements only and performs a compensating action on FM broadcast signals, (c) and an AM compensating circuit is provided which is formed with active elements, which convert a high impedance into a low impedance, and performs a compensating action on AM broadcast signals.

In the present invention, since the stray capacitance of the attachment part of the antenna is controlled to 10 PF or less, matching loss is reduced and the reception sensitivity drop can be alleviated. As a result, the FM compensating circuit can be constructed using only passive elements. Thus, distortion of the received sound in cases where strong electromagnetic waves are received can be prevented, and faulty reception can be prevented in cases where the reception of other electromagnetic waves among strong electromagnetic waves is attempted. Furthermore, since the output impedance of the AM compensating circuit is low, capacitance splitting loss of the antenna and feeder line is reduced, the reception sensitivity drop is prevented, and the antenna as a whole is inexpensive to manufacture.

BRIEF DESCRIPTION OF THE DRAWINGS

FIG. 3(2) shows the equivalent circuit related to FM frequency characteristics in FIG. 3(1);

FIG. 4(2) shows the equivalent circuit related to AM frequency characteristics in FIG. 4(1);

DETAILED DESCRIPTION OF THE INVENTION

Figure 1:
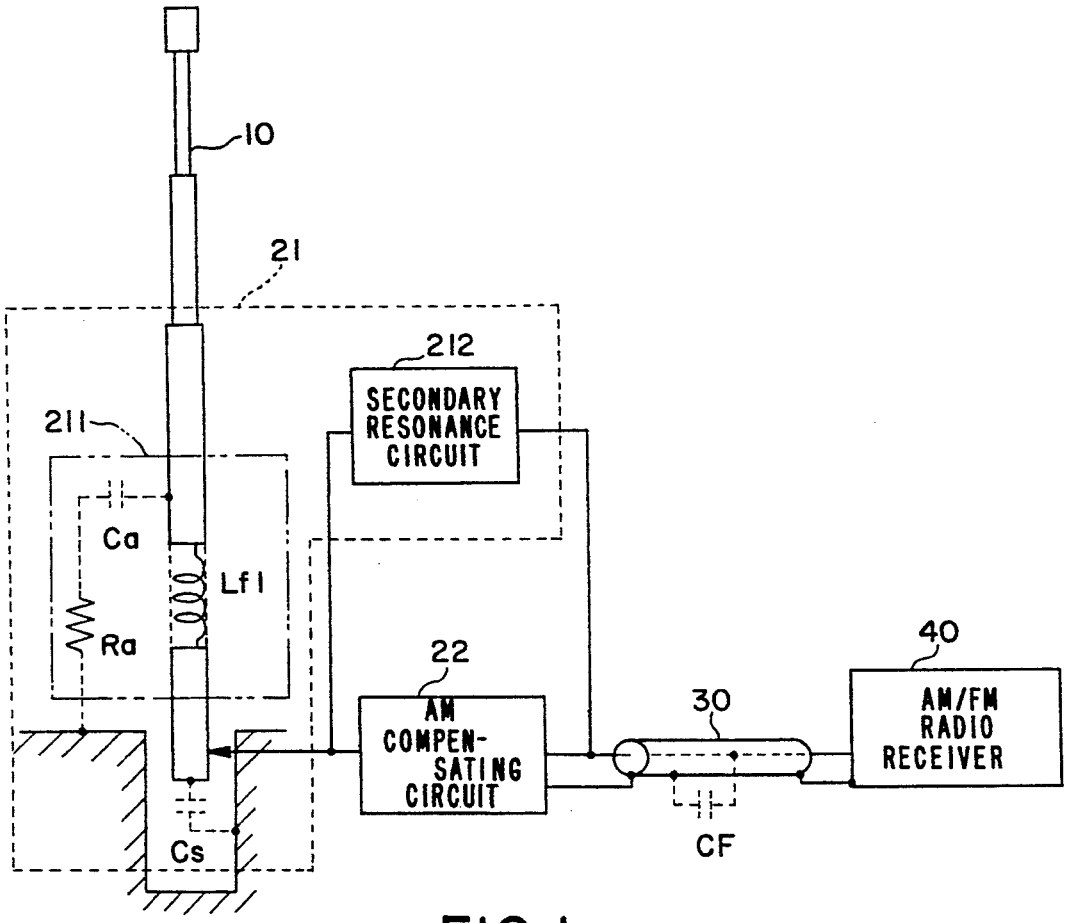
FIG. 1 is a circuit diagram of one embodiment of the present invention, showing a case where a 50 cm shortened mast is used.
Figure 2:
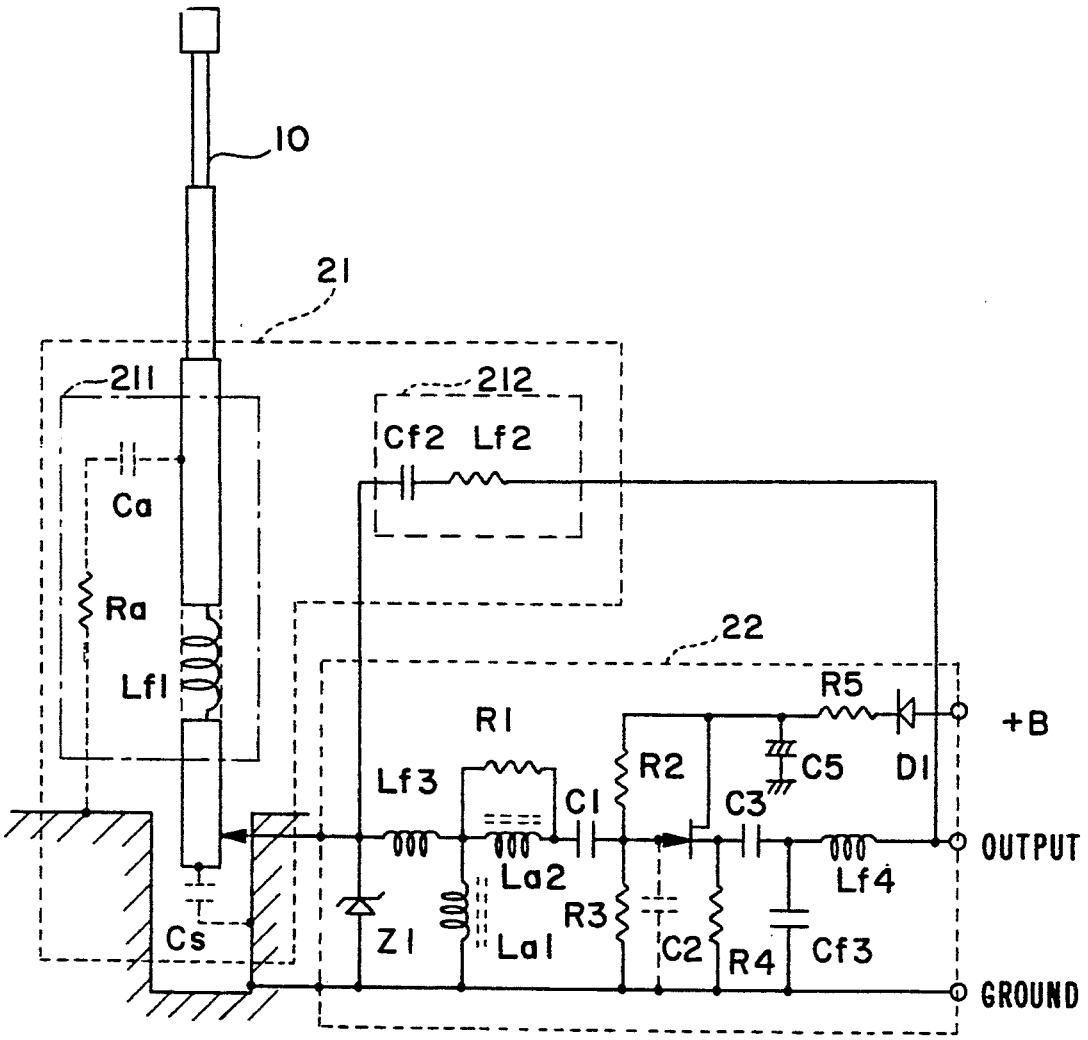
FIG. 2 is a diagram which illustrates a radio receiver system used for the embodiment of FIG. 1.

FIG. 1 is a circuit diagram which illustrates one embodiment of the present invention. This diagram is a circuit diagram for an antenna using a 50 cm short-mast. FIG. 2 is a diagram of a radio receiver system for such embodiment.

In the embodiment, a compensating circuit 20 is directly connected to a telescopic mast antenna 10. The compensating circuit 20 contains an FM compensating circuit 21 and an AM compensating circuit 22. The FM compensating circuit 21 is a circuit which consists only of passive elements to perform a compensating action on FM broadcast signals. The AM compensating circuit 22 is a circuit which includes active elements that convert a high impedance into a low impedance. The AM compensating circuit 22 performs a compensating action on AM broadcast signals.

The compensating circuit 20 is directly connected to the antenna mast 10 in order to minimize the stray capacitance Cs on the antenna 10 side. Thus, the stray capacitance Cs at the attachment part of the antenna 10 is 10 PF or less.

For the coils L and capacitors C in the compensating circuit 20, an appended "a" indicates that the parts are used for AM reception, while an appended "f" indicates that the parts are used for FM reception.

The surge protector Z1 protects the FET (described later) by absorbing high-voltage static electricity generated in the antenna 10. The diode D1 protects the FET when DC power source is erroneously connected in reverse. The choke coils Lf3 and Lf4 are used to stop FM broadcast waves; these coils isolate the AM compensating circuit 22 from the FM compensating circuit 21.

The coil La1 and resistor R1 in the FM compensating circuit 21 are circuit elements which make up a band-pass filter in the AM frequency band. In the FM frequency band, these elements can be ignored, but, the coil stray capacitance Cs' which is parallel with the coil La1 cannot be ignored. This electrostatic capacitance Cs' is combined with the capacitance Cfc and is caused to act as a coupling capacitance. The electrostatic capacitance Cs' itself is not shown in the figures; however, this capacitance Cs' is included in the electrostatic capacitance Cfc shown in FIG. 4(1).

In the FM compensating circuit 21 is a double-tuned circuit consisting of a primary side resonance circuit, a secondary side resonance circuit, and a coupling capacitance Cfc. The primary side resonance circuit consists of a series resonance circuit which is formed by the resistance component Ra of the antenna 10, the capacitance component Ca of the antenna 10 plus the stray capacitance Cs, and the coil Lf1. The secondary side resonance circuit consists of a series resonance circuit formed by the capacitor Cf2 and coil Lf2. The coupling capacitance Cfc couples the primary side resonance circuit and the secondary side resonance circuit.

The AM compensating circuit 22 has an FET. The FET is caused to act as a source follower. Specifically, AM broadcast signals are received at a high impedance and outputted at a low impedance of 100 to 200 ohms.

The AM compensating circuit 22 has an input side band-pass filter. The low cut-off characteristics of this input side band-pass filter are determined by the stray capacitance Cs, the coupling electrostatic capacitance Cfc of the FM compensating circuit 21, and the inductance Lal inserted in parallel with the coupling electrostatic capacitance Cfc. The high-range cut-off characteristics of the input side band-pass filter are determined by the input capacitance C2 of the FET and inductance La2.

Figure 3:
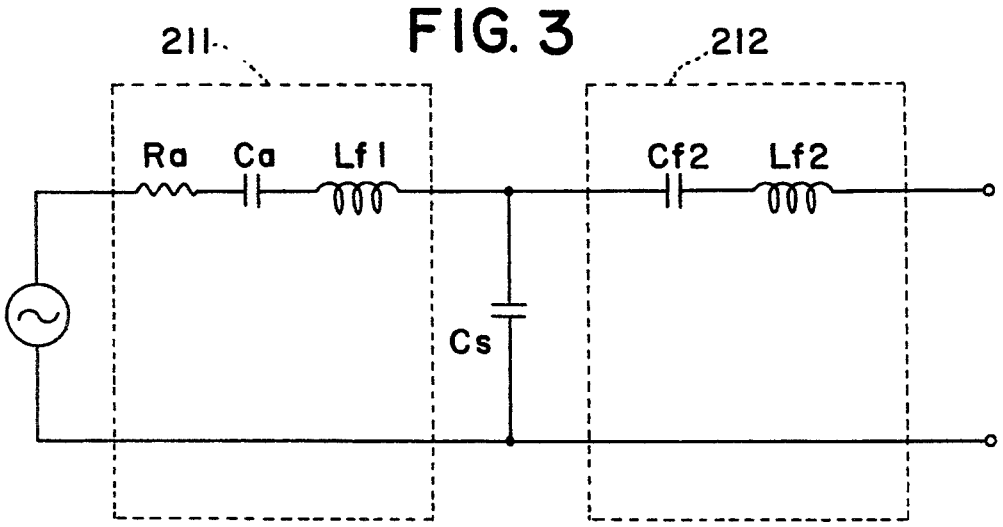
FIG. 3(1) is a circuit diagram which shows an equivalent circuit of the FM compensating circuit and the antenna in the FM frequency band in the embodiment of FIG. 1.

Next, the operation of the above-described embodiment will be explained:

FIG. 3(1) is a circuit diagram which shows an equivalent circuit of the FM compensating circuit 21 and the antenna in the FM frequency band. FIG. 3(2) shows an equivalent circuit particularly showing the parts related to the FM frequency characteristics.

In the embodiment, the stray capacitance Cs is small, i.e., 10 PF or less. Accordingly, as seen from FIG. 1, the FM compensating circuit 21 (i.e., the circuit which matches the antenna 10 and the feeder line 30) can be constructed using passive elements only. As a result, there is no distortion in the case of strong input signals, and the overall cost of the antenna is lower than it is when active elements are used. Moreover, there is no need for a power source.

Furthermore, since a double-tuned circuit including the antenna 10 is formed, impedance matching between the antenna 10 and the feeder line 30 can be favorably accomplished. Also, a broad band width can be obtained which allows coverage of the entire FM broadcast band.

In addition, since the antenna 10 is in a non-resonant state, it has a reactance component. Accordingly, circuit loss can be minimized and circuit simplification can be achieved by selecting the circuit constants of the primary side resonance circuit of the double-tuned circuit so that the resonance circuit resources in the FM frequency band (including the antenna reactance and stray capacitance Cs).

Since the stray capacitance Cs is small, there is no great drop in the apparent antenna resistance. Accordingly, a circuit which matches the antenna 10 and feeder line 30 can be constructed using only passive elements.

The band width required for FM broadcast reception can be obtained by appropriately selecting the coupling capacitance Cfc, and the antenna 10 and feeder line 30 can be effectively matched by appropriately selecting the capacitance ratio of the capacitance component Ca of the antenna 10 to the capacitor Cf2.

Figure 5:
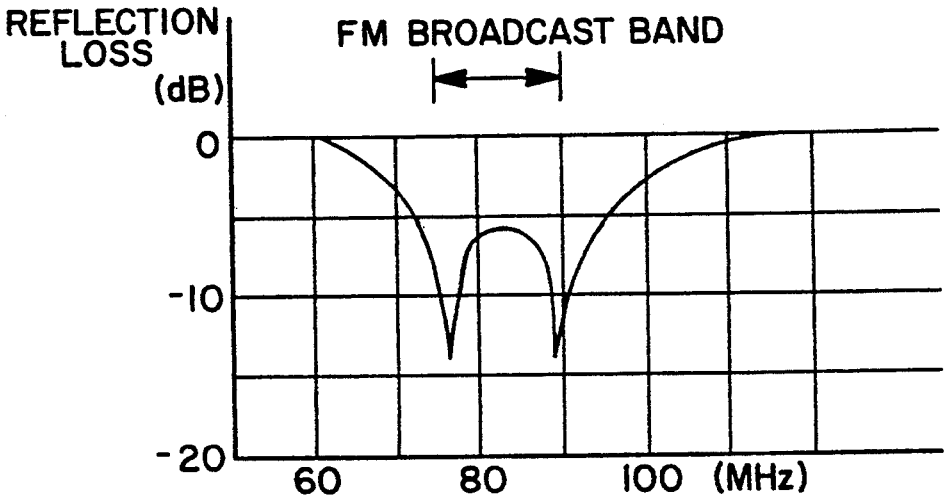
FIG. 5 is a graph showing the FM reflection loss characteristics looking at the antenna side from the output terminal of the embodiment of FIG. 1.
Figure 6:
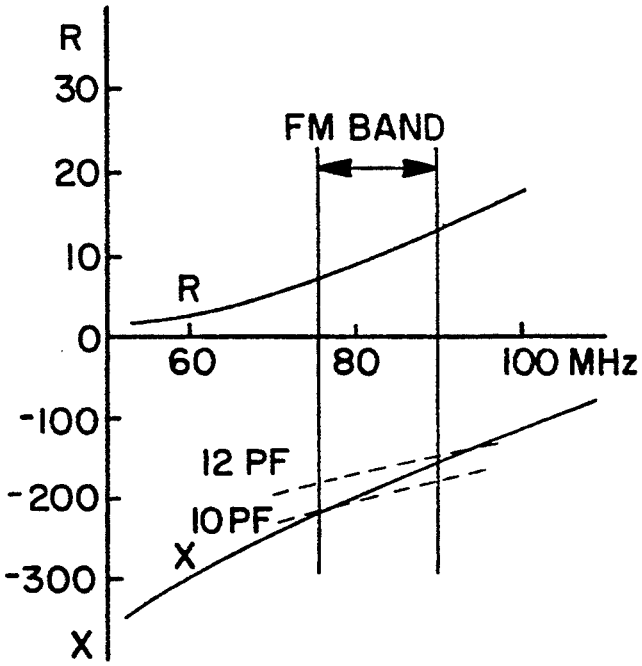
FIG. 6(1) PRIOR ART
FIGS. 6(1) and 6(2) are graphs showing impedance characteristics of a conventional shortened mast antenna.
Figure 6:
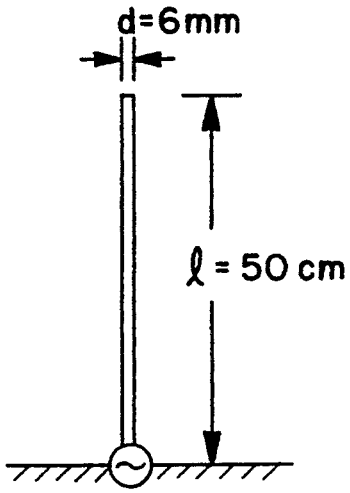
FIG. 6(2) PRIOR ART

FIG. 5 shows the reflection loss characteristics looking at the antenna side from the output terminal of the embodiment.

Figure 4:
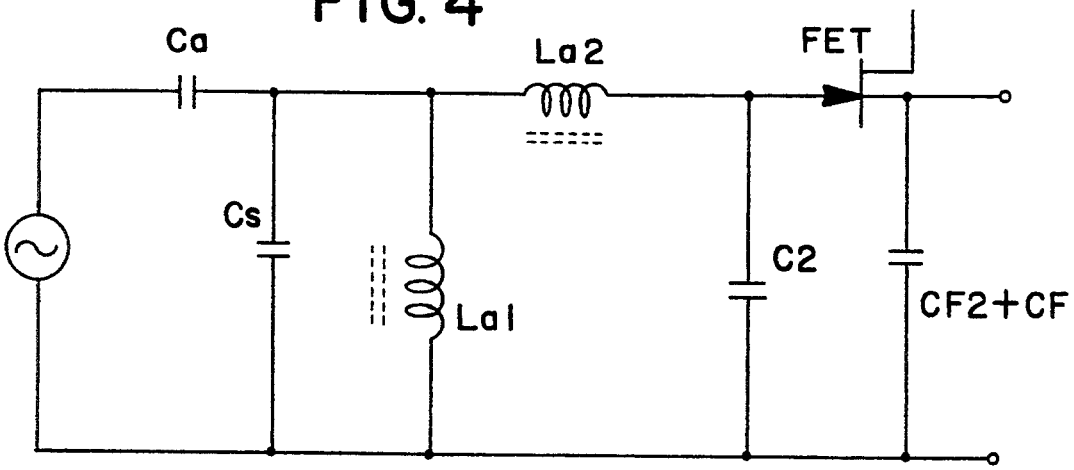
FIG. 4(1) is a circuit diagram which shows an equivalent circuit of the AM compensating circuit and the antenna in the AM frequency banding the embodiment of FIG. 1.

Next, the operation of the AM compensating circuit 22 will be described:

FIG. 4(1) is a circuit diagram which shows an equivalent circuit of the AM compensating circuit 22 and the antennas in the AM frequency band. FIG. 4(2) shows an equivalent circuit particularly showing the parts related to the AM frequency characteristics.

The FET in the AM compensating circuit 22 performs an active impedance conversion, so that the output impedance of the AM compensating circuit 22 is lowered to a value of approximately 100 to 200 ohms. Accordingly, the capacitance splitting loss arising from the feeder line 30 can be reduced to such an extent that it can virtually be ignored. In other words, even if a capacitance of 150 to 300 PF is connected in parallel with the output of the FET, such a capacitance will have almost no effect, because the output impedance of the AM compensating circuit 22 is low. Accordingly, a 50 to 75 ohm coaxial cable, which is optimal for FM transmission, can be used as the feeder line 30.

Since the FET is caused to act as a source follower, the input-output characteristics can be caused to act in a linear manner up to approximately ½ the DC power supply voltage. As a result, operation which is free from various types of non-linear distortion can be achieved up to a strong input signal of approximately 130 dB u. Accordingly, absolutely no problem would arise under normal use.

It would be possible to use a coupling inductance instead of the coupling capacitance Cfc in order to couple the primary side resonance circuit and the secondary side resonance circuit in the FM compensating circuit 21. It would also be possible to use an emitter follower transistor instead of the FET in the AM compensating circuit 22.

As described above, according to the present invention which is for an automobile radio antenna used in a state shorter than the resonant state of the antenna, distortion of the received sound in cases where strong electromagnetic waves are received can be prevented, and faulty reception can be prevented in cases where it is desired to receive other waves among strong electromagnetic waves. There is little matching loss between the antenna and the feeder line, so that it is possible to prevent the practical reception sensitivity drop. In addition, the compensating circuits are inexpensive.

We claim:

1. A shortened mast antenna equipped with compensating circuits, said antenna having a length shorter than a resonant length at AM and FM broadcast bands and comprising:

an attachment part of said antenna which has a stray capacitance of not greater than 10 PF;

an FM compensating circuit coupled to said attachment part which consists of passive elements only and having an output connected directly to a feeder line to be coupled to an input of a receiver, said FM compensating circuit for reducing distortion of and increasing the sensitivity to FM broadcast signals; and an AM compensating circuit coupled to said attachment part equipped with active elements that convert a high impedance into a low impedance and having an output connected directly to said feeder line to be coupled to said input of said receiver, said AM compensating circuit for reducing distortion of and increasing sensitivity to AM broadcast signals.

2. A shortened mast antenna according to claim 1, wherein said FM compensating circuit consists of a primary resonance circuit and a secondary resonance circuit, said primary resonance circuit including an input impedance of said shortened mast antenna and said stray capacitance provided in parallel with said input impedance and resonating in the FM frequency band, and said primary resonance circuit and secondary resonance circuit being coupled by a coupling electrostatic capacitance so as to form a double-tuned circuit.

3. A shortened mast antenna according to claim 2, wherein said AM compensating circuit is provided with an input side band-pass filter, a low cut-off characteristics of the input side of said band-pass filter being determined by the stray capacitance on an antenna side of the input side band-pass filter, the coupling electrostatic capacitance of the FM compensating circuit and an inductance which is inserted in parallel with said coupling electrostatic capacitance, and a high-range cut-off characteristics of said input side of band-pass filter being determined by an input capacitance of said active elements and an inductance which is inserted in series with an addition capacitance.

4. A shortened mast antenna according to claim 1, wherein said FM compensating circuit consists of a primary resonance circuit and a secondary resonance circuit, said primary resonance circuit including an input impedance of said shortened mast antenna and said stray capacitance provided in parallel with said input impedance and resonating in the FM frequency band, and said primary resonant circuit and secondary resonant circuit being coupled by a coupling inductance so as to form a double-tuned circuit.

* * * * *